US010871118B2

(12) United States Patent
Surnilla et al.

(10) Patent No.: US 10,871,118 B2
(45) Date of Patent: Dec. 22, 2020

(54) SYSTEMS AND METHODS FOR REDUCING A LIGHT-OFF TIME OF AN OXYGEN SENSOR

(71) Applicant: Ford Global Technologies, LLC, Dearborn, MI (US)

(72) Inventors: Gopichandra Surnilla, West Bloomfield, MI (US); Hao Zhang, Ann Arbor, MI (US); Richard E. Soltis, Saline, MI (US); William Russell Goodwin, Farmington Hills, MI (US); Robert F. Novak, Farmington Hills, MI (US); David Bilby, Auburn Hills, MI (US); Evangelos P. Skoures, Detroit, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 250 days.

(21) Appl. No.: 15/811,085

(22) Filed: Nov. 13, 2017

(65) Prior Publication Data

US 2019/0145333 A1 May 16, 2019

(51) Int. Cl.
*F02D 41/14* (2006.01)
*F02D 41/06* (2006.01)

(52) U.S. Cl.
CPC ..... *F02D 41/1494* (2013.01); *F02D 41/1446* (2013.01); *F02D 41/064* (2013.01); *F02D 41/1482* (2013.01); *F02D 41/1483* (2013.01); *F02D 2041/141* (2013.01)

(58) Field of Classification Search
CPC ..... F02D 41/1494; F02D 41/1446; F02D 41/064; F02D 41/1482; F02D 41/1483; F02D 2041/141
See application file for complete search history.

(56) References Cited

U.S. PATENT DOCUMENTS

| | | | | |
|---|---|---|---|---|
| 4,611,562 | A * | 9/1986 | Nakano | F02D 41/1494 123/697 |
| 4,938,196 | A * | 7/1990 | Hoshi | F02D 41/1494 123/697 |
| 5,852,228 | A | 12/1998 | Yamashita et al. | |
| 7,467,628 | B2 | 12/2008 | Adams et al. | |
| 9,664,132 | B2 | 5/2017 | McQuillen et al. | |
| 2016/0169138 | A1 * | 6/2016 | McQuillen | F02D 41/1494 219/497 |

* cited by examiner

*Primary Examiner* — Daniel S Larkin
*Assistant Examiner* — Anthony W Megna Fuentes
(74) *Attorney, Agent, or Firm* — Geoffrey Brumbaugh; McCoy Russell LLP

(57) ABSTRACT

Methods and systems are provided for an oxygen sensor heater. In one example, a method may include applying a less than maximum duty cycle of voltage to the oxygen sensor heater during an engine cold start (e.g., when a temperature of the oxygen sensor is less than its light-off temperature) and adjusting the applied duty cycle of voltage to maintain a constant amount of power. In this way, the oxygen sensor may be heated at a constant rate even as a resistance of the oxygen sensor heater increases, decreasing an amount of time before the oxygen sensor reaches its light-off temperature.

7 Claims, 5 Drawing Sheets

SYSTEMS AND METHODS FOR REDUCING A LIGHT-OFF TIME OF AN OXYGEN SENSOR

FIELD

The present description relates generally to methods and systems for exhaust gas oxygen sensors in a vehicle system.

BACKGROUND/SUMMARY

Intake and/or exhaust gas sensors may provide indications of various gas constituents in an engine system. For example, an oxygen sensor positioned in an engine exhaust system may be used to determine the air-fuel ratio (AFR) of exhaust gas, while an oxygen sensor positioned in an engine intake system may be used to determine a concentration of recirculated exhaust gas in intake charge air. Both parameters, among others that may be measured via an oxygen sensor, may be used to adjust various aspects of engine operation. For example, an engine may be controlled in a closed-loop manner to achieve a desired exhaust gas AFR based on the AFR indicated by an oxygen sensor. Such closed-loop AFR control may maximize operating efficiency of an emission control device to reduce vehicle emissions, for example. For some oxygen sensors, their output may significantly vary as a function of their temperature. Accordingly, such oxygen sensors may be heated by a heating element to bring the sensor temperature within a desired range, such as above a light-off temperature, to provide accurate oxygen sensing for closed-loop AFR control. Prior to the oxygen sensor reaching its light-off temperature, such as during an engine cold start, the AFR may be controlled in an open-loop manner, which is less accurate than the closed-loop control. Therefore, the oxygen sensor heater may be controlled to bring the oxygen sensor above its light-off temperature.

Other strategies for controlling an oxygen sensor heater during an engine cold start include providing a high duty cycle of voltage to the oxygen sensor heater. One example approach is shown by Yamashita et al. in U.S. Pat. No. 5,852,228. Therein, immediately after an engine is started, voltage is supplied to an oxygen sensor heater at 100% duty cycle (e.g., maximum voltage is supplied) to quickly raise a temperature of the heater to a target temperature. Then, once the heater reaches the target temperature, an amount of power supplied to the heater is controlled to maintain the target temperature. For example, the amount of power supplied to the heater may be feedback-controlled based on an impedance of the heater, such as when the impedance is a detectable value, due to a defined relationship between the heater impedance and the heater temperature.

However, the inventors herein have recognized potential issues with such systems. As one example, while the heater is supplied with constant (maximum) voltage following the engine start, as the temperature of the heater increases, the resistance of the heater increases. As the resistance of the heater increases, the amount of power supplied to the heater decreases. The decreased heater power increases the amount of time it takes the oxygen sensor to reach its light-off temperature, thereby delaying closed-loop AFR control. For example, it may take the oxygen sensor more than 10 seconds to reach light-off by supplying constant voltage. The delayed closed-loop AFR control increases vehicle emissions, particularly because an emission control device may not be operating above its light-off temperature, and reduces fuel economy. Reduced vehicle emissions during engine cold starts are needed to meet increasingly stringent emissions standards.

In one example, the issues described above may be addressed by a method, comprising: applying a less than maximum duty cycle of voltage to a heater of an oxygen sensor during an engine cold start; and adjusting the applied duty cycle of voltage to provide a target amount of power. In this way, a constant amount of power may be supplied to the heater.

As one example, adjusting the applied duty cycle of voltage includes increasing the applied duty cycle of voltage as a function of time since power was most recently applied to the heater to maintain a substantially constant heating rate. For example, the substantially constant heating rate may be a maximum heating rate to avoid oxygen sensor degradation due to thermal shock. Further, in some examples, the heater may be engineered to have decreased resistance, and thus, applying the less than maximum duty cycle of voltage may ensure that a maximum sensor current is not exceeded. By adjusting the applied duty cycle of voltage to provide the target amount of power, as a resistance of the oxygen sensor heater increases due to the increasing oxygen sensor temperature, the oxygen sensor temperature continues to rise at the substantially constant heating rate until the oxygen sensor temperature reaches a closed-loop oxygen sensor operating temperature (e.g., an oxygen sensor temperature where the oxygen sensor outputs a current that is proportionate to oxygen concentration sensed via the oxygen sensor). As a result, the oxygen sensor may reach its light-off temperature faster than when constant voltage is supplied (and the heating rate decreases as the oxygen sensor temperature increases), enabling faster closed-loop AFR control and reducing vehicle cold start emissions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
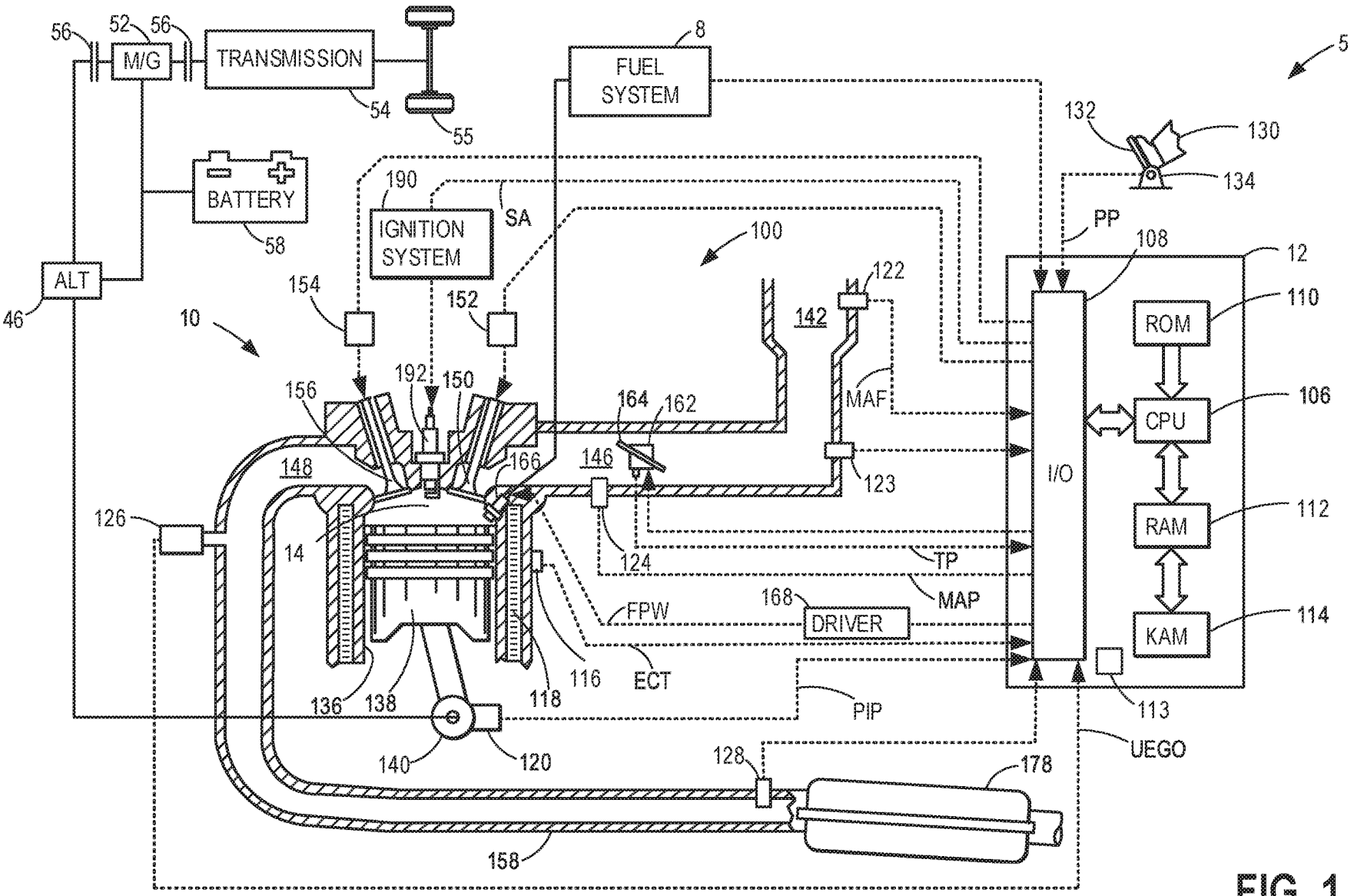
FIG. 1 shows a schematic depiction of an engine system of a vehicle.
Figure 2:
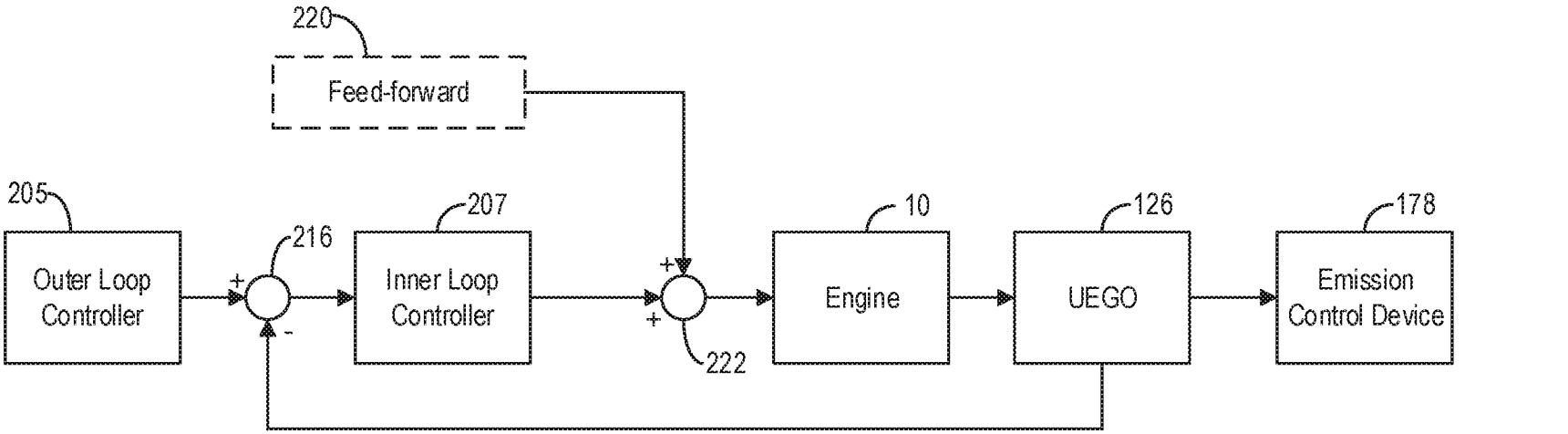
FIG. 2 shows a block diagram illustrating an example control architecture for generating a fuel command using feedback from an oxygen sensor.

The following description relates to systems and methods for controlling an oxygen sensor heater during an engine cold start in order to expedite sensor heating and reduce vehicle emissions. As shown in FIG. 1, an engine system may include an exhaust gas oxygen sensor upstream of an emission control device. The upstream exhaust gas oxygen sensor may be a UEGO sensor, such as the example UEGO sensor diagrammed in FIG. 3, configured to measure an amount of oxygen in the exhaust gas. Engine operation may be controlled based on feedback from the UEGO sensor, as shown in FIG. 2, in order to achieve a desired AFR. During an engine cold start, such as when the engine has cooled to ambient temperature, the UEGO sensor is below its light-off temperature and cannot be used for AFR feedback because the oxygen sensor's output current is not proportionate to a concentration of oxygen sensed by the oxygen sensor, which increases vehicle emissions during the cold start. By reducing the oxygen sensor heater resistance and supplying a constant amount of power to the heater, such as according to the example method of FIG. 4, an amount of time it takes the UEGO sensor to reach its light-off temperature may be decreased, thereby decreasing vehicle emissions. An example timeline for heating the oxygen sensor during an engine cold start is shown in FIG. 5.

FIG. 1 depicts an example of a cylinder 14 of an internal combustion engine 10, which may be included in an engine system 100 in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 of the vehicle via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown in FIG. 1, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via an intake passage 142 and an intake manifold 146. Intake manifold 146 can communicate with other cylinders of engine 10 in addition to cylinder 14. In some examples, intake passage 142 may include one or more boosting devices, such as a turbocharger or a supercharger, coupled therein when the engine system is a boosted engine system. A throttle 162 including a throttle plate 164 may be provided in the intake passage for varying the flow rate and/or pressure of intake air provided to the engine cylinders. An exhaust manifold 148 can receive exhaust gases from cylinder 14 as well as other cylinders of engine 10.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

An exhaust gas sensor 126 is shown coupled to exhaust manifold 148 upstream of an emission control device 178, coupled within an exhaust passage 158. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor configured to provide an output, such as a voltage signal, that is proportional to an amount of oxygen present in the exhaust gas. An example UEGO sensor configuration will be further described with respect to FIG. 3. Emission control device 178 may be a three-way catalyst, a NOx trap, various other emission control devices, or combinations thereof. In the example of FIG. 1, emission control device 178 is a three-way catalyst configured to reduce NOx and oxidize CO and unburnt hydrocarbons.

The output current of UEGO sensor 126 may be used to adjust engine operation. For example, the amount of fuel delivered to cylinder 14 may be varied using a feed-forward (e.g., based on desired engine torque, engine airflow, etc.) and/or feedback (e.g., using oxygen sensor output) approach. Turning briefly to FIG. 2, a block diagram of a control architecture 200 that may be implemented by an engine controller, such as controller 12 shown in FIG. 1, for generating a fuel command is illustrated. Components described in FIG. 2 that have the same identification labels as components shown in FIG. 1 are the same devices and operate as previously described. For example, control architecture 200 includes engine 10 and UEGO sensor 126 upstream of emission control device 178.

Control architecture 200 regulates the engine AFR to a set point near stoichiometry (e.g., a commanded AFR) in a closed-loop manner. Inner loop controller 207, comprising a proportional-integral-derivative (PID) controller, controls the engine AFR by generating an appropriate fuel command (e.g., fuel pulse width). Summing junction 222 optionally combines the fuel command from inner loop controller 207 with commands from a feed-forward controller 220. This combined set of commands is delivered to the fuel injectors of engine 10, such as fuel injector 166 shown in FIG. 1.

UEGO sensor 126 provides a feedback signal to inner loop controller 207. The UEGO feedback signal is proportional to the oxygen concentration in the engine exhaust between engine 10 and emission control device 178. The oxygen concentration may be indicative of an engine air-fuel ratio. For example, the output of UEGO sensor 126 may be used to evaluate an error between a commanded (e.g., desired) AFR and an actual (e.g., measured) AFR. Under nominal UEGO sensor operating conditions (e.g., after UEGO sensor 126 has reached its light-off temperature where sensor output current is proportionate to concentration of oxygen sensed), such an error may be due to fuel injector and/or air metering errors, for example.

An outer loop controller 205 generates a UEGO reference signal provided to inner loop controller 207. The UEGO reference signal corresponds to a UEGO output indicative of the commanded AFR. The UEGO reference signal is combined with the UEGO feedback signal at junction 216. The error or difference signal provided by junction 216 is then used by inner loop controller 207 to adjust the fuel command to drive the actual AFR of engine 10 to the desired AFR. Outer loop controller 205 may be any reasonable controller containing an integral term, such as a proportional-integral (PI) controller.

In this way, controller 12 may accurately control the AFR of engine 10 based on feedback from UEGO sensor 126 and adaptively learn fuel injector and/or air metering errors, which can then be compensated for by adjusting the fuel command (e.g., signal FPW) until the actual AFR reaches the desired AFR. For example, if UEGO sensor 126 measures a rich fuel condition, an amount of fuel delivered will be reduced (e.g., by reducing a pulse-with of signal FPW). Conversely, if UEGO sensor 126 measures a lean fuel condition, the amount of fuel delivered will be increased (e.g., by increasing a pulse-width of signal FPW). However, the closed-loop fuel control of control architecture 200 may not be utilized before UEGO sensor 126 reaches its light-off temperature, as oxygen measurements taken prior to UEGO sensor 126 reaching its light-off temperature may not be accurate. For example, UEGO sensor 126 may not have reached its light-off temperature during an engine cold start, as further described below.

Returning to FIG. 1, controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an ambient temperature from a temperature sensor 123 coupled to intake passage 142; an exhaust gas temperature from a temperature sensor 128 coupled to exhaust passage 158; a profile ignition pickup signal (PIP) from a Hall effect sensor 120 (or other type) coupled to crankshaft 140; throttle position (TP) from the throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature. Further, controller 12 is shown having a current sensor 113, which may be used to detect a current output by a sensor, such as UEGO sensor 126, as further described below. Additional sensors, such as various temperature, pressure, and humidity sensors, may be coupled throughout vehicle 5.

Controller 12 receives signals from the various sensors of FIG. 1 and employs the various actuators of FIG. 1 to adjust engine operation based on the received signals and instructions stored on a memory of the controller. For example, the controller may determine an amount of power (and a corresponding voltage) to supply to a heater of UEGO sensor 126 to quickly raise UEGO sensor 126 to its operating temperature, as will be described with respect to FIG. 4.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Figure 3:
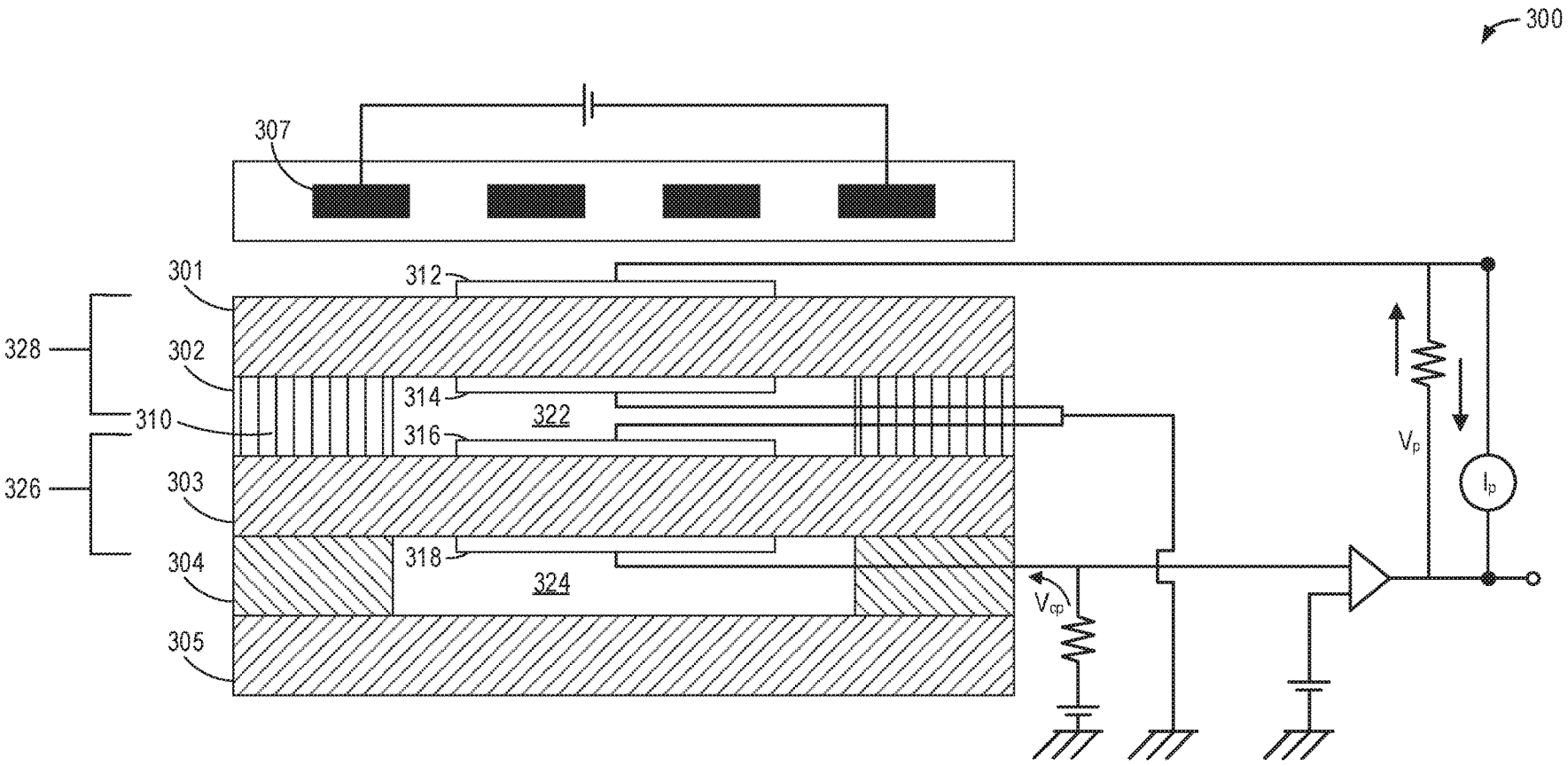
FIG. 3 shows a schematic diagram of an example oxygen sensor.

Next, FIG. 3 shows a schematic view of an example configuration of an oxygen sensor 300 for measuring a concentration of oxygen ($O_2$) in an intake airflow in an intake passage or an exhaust gas stream in an exhaust passage of an engine. Oxygen sensor 300 may operate as UEGO sensor 126 of FIGS. 1 and 2, for example. Oxygen sensor 300 comprises a plurality of layers of one or more ceramic materials arranged in a stacked configuration. In the example of FIG. 3, five ceramic layers are depicted as layers 301, 302, 303, 304, and 305. These layers include one or more layers of a solid electrolyte capable of conducting oxygen ions. Examples of suitable solid electrolytes include, but are not limited to, zirconium oxide-based materials. Further, in some embodiments, a heater 307 may be disposed in thermal communication with the layers to increase the ionic conductivity of the layers. As an example, the temperature of heater 307 may correspond to the temperature of oxygen sensor 300 due to the close physical proximity of heater 307 with the ceramic layers. While the depicted oxygen sensor 300 is formed from five ceramic layers, it will be appreciated that oxygen sensor 300 may include other suitable numbers of ceramic layers.

Layer 302 includes a material or materials creating a diffusion path 310. The diffusion path 310 may be configured to allow one or more components of intake air or exhaust gas, including but not limited to a desired analyte (e.g., $O_2$), to diffuse into a first internal cavity 322 at a more limiting rate than the analyte can be pumped into or out of first internal cavity 322 by a pair of pumping electrodes 312 and 314. In this manner, a stoichiometric level of $O_2$ may be obtained in first internal cavity 322.

Oxygen sensor 300 further includes a second internal cavity 324 within layer 304, which is separated from first internal cavity 322 by layer 303. Second internal cavity 324 is configured to maintain a constant oxygen partial pressure equivalent to a stoichiometric condition. An oxygen level (e.g., concentration) present in second internal cavity 324 is equal to the oxygen level that the intake air or exhaust gas would have if the air-fuel ratio were stoichiometric. The oxygen concentration in second internal cavity 324 is held constant by a pumping voltage $V_{cp}$. For example, second internal cavity 324 may be a reference cell.

A pair of sensing electrodes 316 and 318 is disposed in communication with first internal cavity 322 and second internal cavity 324. Sensing electrodes 316 and 318 detect a concentration gradient that may develop between first internal cavity 322 and second internal cavity 324 due to an oxygen concentration in the intake air or exhaust gas that is higher than or lower than the stoichiometric level. A high oxygen concentration may be caused by a lean mixture, while a low oxygen concentration may be caused by a rich mixture. Together, layer 303 and sensing electrodes 316 and 318 comprise a sensing cell 326.

The pair of pumping electrodes 312 and 314 is disposed in communication with first internal cavity 322 and is configured to electrochemically pump a selected gas constituent (e.g., $O_2$) from first internal cavity 322, through layer 301, and out of oxygen sensor 300. Alternatively, the pair of pumping electrodes 312 and 314 may be configured to electrochemically pump a selected gas through layer 301 and into internal cavity 322. Together, layer 301 and pumping electrodes 312 and 314 comprise a pumping cell 328.

The electrodes 312, 314, 316, and 318 may be made of various suitable materials. In some embodiments, the electrodes 312, 314, 316, and 318 may be at least partially made of a material that catalyzes the dissociation of molecular oxygen. Examples of such materials include, but are not limited to, platinum and silver.

The process of electrochemically pumping the oxygen out of or into the first internal cavity 322 includes applying a pumping voltage $V_p$ across pumping cell 328 (e.g., across the pumping electrode pair 312 and 314). The pumping voltage $V_p$ applied to pumping cell 328 pumps oxygen into or out of the first internal cavity 322 in order to maintain a stoichiometric level of oxygen therein. The resulting pumping current $I_p$ is proportional to the concentration of oxygen in the intake air or exhaust gas when the oxygen sensor is at operating temperature (e.g., above light off temperature), which may be used to adjust engine operation, as described with respect to FIG. 2. A control system (not shown in FIG. 3) generates the pumping current signal $I_p$ as a function of the intensity of the applied pumping voltage $V_p$ required to maintain a stoichiometric level within first internal cavity 322. Thus, a lean mixture will cause oxygen to be pumped out of first internal cavity 322, and a rich mixture will cause oxygen to be pumped into first internal cavity 322.

It should be appreciated that the oxygen sensor described herein is merely an example embodiment of an oxygen sensor, and that other embodiments of oxygen sensors may have additional and/or alternative features and/or designs.

Because the output of an oxygen sensor (e.g., oxygen sensor 300 of FIG. 3) may vary significantly with temperature, accurate control of the oxygen sensor temperature may be desired. For example, the oxygen sensor may provide desired sensing above a lower threshold temperature. The lower threshold temperature may be a light-off temperature of the oxygen sensor, for example (e.g., between 720° C. and 830° C.). Therefore, the oxygen sensor temperature may be raised to the lower threshold temperature under conditions in which the oxygen sensor temperature is below the lower threshold temperature (e.g., at an engine cold start). For example, the oxygen sensor temperature may be raised to the lower threshold temperature during an oxygen sensor heat up period via a heater of the oxygen sensor (e.g., heater 307 of FIG. 3). The heater may be comprised of one or more materials (e.g., platinum), where a resistance (R) of the one or more materials is directly proportional (e.g., linear) to its temperature (T). As the heater temperature increases, the resistance of the heater increases, as illustrated by a resistance-temperature transfer function: $R=m\times T+b$, where m is a slope relating the resistance of the one or more materials to the temperature of the one or more materials and b is an offset, such as a resistance of the one or more materials at absolute zero.

Because power (P) is equal to a square of the voltage (V) divided by the resistance (e.g., $P=V^2/R$), the increasing heater resistance during the oxygen sensor heat up period decreases the heater power throughout the oxygen sensor heat up period for a given constant voltage supplied to the heater (e.g., 12 V). The decreasing heater power in turn increases a duration of the oxygen sensor heat up period. Therefore, by engineering the heater with reduced heater resistance, the heater power during the oxygen sensor heat up period may be increased and the duration of the oxygen sensor heat up period may be decreased. For example, the heater may be engineered to have reduced resistance by lowering the resistance of leads of the heater and/or a serpentine of the heater, such as by increasing a cross-sectional area of the heater and the leads. The heater may be manufactured through screen printing process, for example. Therefore, increasing the cross-sectional area of the heater and the leads may include increasing the width and/or thickness of the heater and the leads, such as via a thicker screen (e.g., emulsion), a redesigned screen with wider features, a multiple print/dry step, or a second heater on an adjoining layer with the same screen. In an alternative example, the heater resistance may be decreased by manufacturing the heater using a different material that has a higher conductivity without changing the cross-sectional area of the heater and the leads. In a further example, the heater resistance may be decreased through a combination of increasing the cross-sectional area of the heater and the leads and using a material with a higher conductivity.

However, raising the oxygen sensor temperature too quickly may degrade the oxygen sensor due to thermal shock. For example, with the heater resistance decreased, if conventional oxygen sensor heater control methods were used, thermal shock may occur due to a higher heater power achievable for a given voltage supplied to the heater. Furthermore, even with the reduced heater resistance, as the temperature of the heater increases, the resistance still increases, which may prolong the duration of the oxygen sensor heat up period. Therefore, effective oxygen sensor heater control methods may account for the changing heater resistance to further reduce the duration of the oxygen sensor heat up period while avoiding oxygen sensor degradation, as described below.

Figure 4:
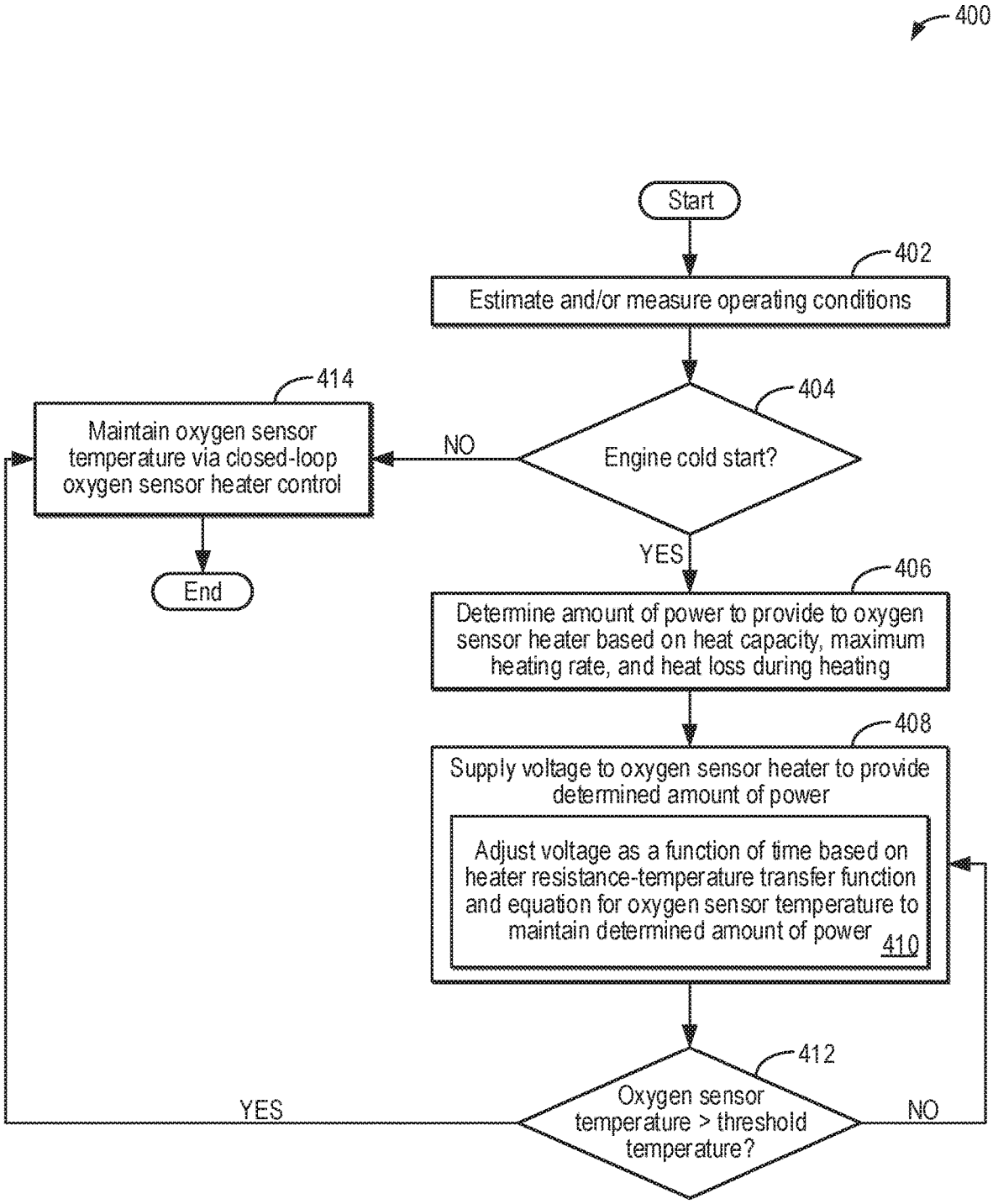
FIG. 4 illustrates an example method for controlling an oxygen sensor heater.
Figure 5:
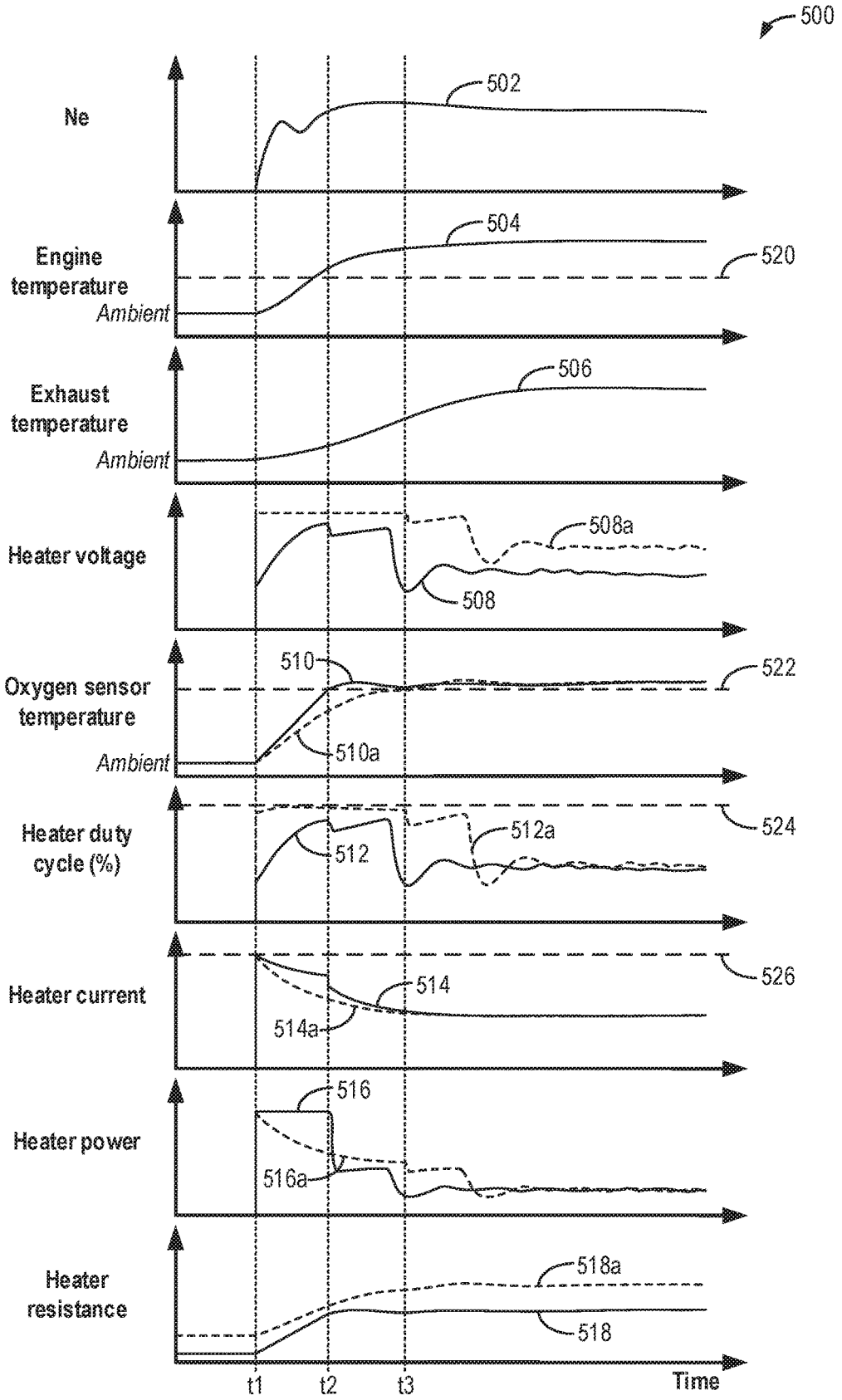
FIG. 5 depicts a prophetic example timeline for heating oxygen sensor during an engine cold start.

FIG. 4 shows an example method 400 for providing constant power to an oxygen sensor heater while a resistance of the heater is changing during an oxygen sensor heat up period (e.g., prior to the oxygen sensor reaching its light-off temperature). For example, the oxygen sensor may be a UEGO sensor included in an engine system, such as UEGO sensor 126 included in engine system 100 of FIG. 1. The oxygen sensor heater (e.g., heater 307 of FIG. 3) may raise a temperature of the oxygen sensor above its light-off temperature and then maintain the temperature of the oxygen sensor at a desired operating temperature. Instructions for carrying out method 400 and the rest of the methods included herein may be executed by a controller (e.g., controller 12 of FIG. 1) based on instructions stored on a memory of the controller and in conjunction with signals received from sensors of the engine system, such as the sensors described above with reference to FIG. 1 (e.g., UEGO sensor 126). The controller may employ engine actuators of the engine system to adjust engine operation according to the methods described below.

At 402, method 400 includes estimating and/or measuring operating conditions. Operating conditions may include engine speed, engine load, engine temperature (e.g., as measured by an engine coolant temperature sensor, such as temperature sensor 116 of FIG. 1), exhaust gas temperature (e.g., as measured by an exhaust gas temperature sensor, such as temperature sensor 128 of FIG. 1), ambient temperature (e.g., as measured by an ambient temperature sensor, such as temperature sensor 123 of FIG. 1), and oxygen sensor temperature, for example. Engine speed may be determined based on a signal PIP output by a Hall effect sensor (e.g., Hall effect sensor 120 of FIG. 1), for example. Engine load may be determined based on a measurement of MAF from a MAF sensor (e.g., MAF sensor 122 of FIG. 1). As one example, the oxygen sensor temperature may be estimated based on the resistance of the oxygen sensor heater, such as according to a resistance-temperature transfer function (e.g., $R=m\times T+b$). Further, the resistance may be determined based on an amount of voltage and current applied to the oxygen sensor heater, for example. As another example, following a vehicle key-on event and when a threshold duration has elapsed since the previous drive cycle (e.g., since the previous vehicle key-off event) and/or when the measured ambient temperature is substantially equal to the measured exhaust temperature (e.g., within a threshold), the oxygen sensor temperature may be estimated as the measured ambient temperature.

At 404, it is determined if an engine cold start condition is present. The cold start condition may be confirmed when the engine is started (e.g., cranked from zero speed to a non-zero speed, with fuel and spark provided to initiated combustion) responsive to an engine start request after a prolonged period of engine inactivity (e.g., after greater than a threshold duration of inactivity) and/or while the engine temperature is lower than a threshold temperature (such as below a light-off temperature of an emission control device). As another example, the cold start condition may be confirmed when the engine temperature is substantially equal to the ambient temperature (e.g., within a threshold of the ambient temperature) at engine start.

If an engine cold start condition is not present, such as when the engine temperature is greater than the threshold temperature or when an engine start is not present, method 400 proceeds to 414 and includes maintaining the oxygen sensor temperature via closed loop oxygen sensor heater control. For example, due to the linear relationship between oxygen sensor heater resistance and oxygen sensor temperature, the oxygen sensor resistance may be used as feedback for maintaining the oxygen sensor temperature. The oxygen sensor heater resistance at a given time after voltage is initially applied to the oxygen sensor after the oxygen sensor heater has been shut off may be determined based on a voltage applied to the oxygen sensor heater (V) and a resulting heater current (I), such as according to the equation:

$$R = \frac{V}{I}.$$

For example, the heater current may be detected by a current sensor (e.g., current sensor 113 of FIG. 1). The heater may be maintained at a desired operating temperature corresponding to a desired resistance by adjusting the amount (e.g., duty cycle) of voltage supplied to the heater to drive the heater resistance to the desired resistance. Following 414, method 400 ends.

If an engine cold start condition is present, method 400 proceeds to 406 and includes determining an amount of power (P) to provide to the oxygen sensor heater based on a heat capacity of the oxygen sensor ($C_h$), a maximum heating rate ($r_{max}$), and heat loss during the heating. For example, to prevent thermal shock, a maximum amount of power ($P_{max}$) that may be supplied to the oxygen sensor heater may be determined based on the maximum heating rate and the heat capacity, such as according to the equation: $P_{max}=r_{max}\times C_h$. As an example, the maximum heating rate may be 270° C./s (e.g., a temperature increase of 270° C. per second of heating) in order to prevent thermal shock. The maximum heating rate is a property of the oxygen sensor and may vary based on a firing process used to form/sinter the ceramic material of the oxygen sensor (e.g., ceramic layers 301, 302, 303, 304, and 305 shown in FIG. 3). Therefore, the maximum heating rate for a particular oxygen sensor model may be measured using conventional thermal analysis techniques and stored as a pre-calibrated value in a non-transitory memory of the controller. By heating the oxygen sensor at the maximum heating rate from a time voltage is applied to the oxygen sensor heater after the heater was shut off most recently until the oxygen sensor reaches a light off temperature where oxygen sensor output is proportionate to concentration of oxygen sensed by the oxygen sensor, the temperature of the oxygen sensor (T) increases from an initial temperature ($T_0$) over time (t) according to the equation: $T=T_0+r_{max}\times t$. As an example, the initial temperature may be the temperature of the oxygen sensor at engine start. As the oxygen sensor is heated, heat loss ($P_{out}$) may occur due to convection, such as due to airflow across the oxygen sensor. Heat loss due to convection may be calculated from the equation: $P_{out}=(T-T_x)\times X(maf)$, where T is the temperature of the oxygen sensor, $T_x$ is the exhaust gas temperature, and X(maf) is a convection coefficient as a function of MAF. For example, the controller may input the measured MAF into a look-up table and output the corresponding convection coefficient. Therefore, the amount of power to provide to the oxygen sensor heater may take into account both heat loss and sensor warm up and may be determined as: $P=(T-T_x)\times X(maf)+r_{max}\times C_h$. As one non-limiting example, the determined amount of power is 40 W.

At 408, method 400 includes supplying voltage to the oxygen sensor heater to provide the determined amount of power. As described above, as the temperature of the oxygen sensor increases during the heat up period (e.g., over time, according to the equation $T=T_0+r_{max}\times t$), the heater resistance increases (e.g., $R=m\times T+b$), which decreases the amount of power provided to the oxygen sensor heater (e.g., $$P = \frac{V^2}{R}\Big).$$

Therefore, supplying the voltage to the oxygen sensor heater to provide the determined amount of power includes adjusting the voltage as a function of time (since voltage was most recently applied to the oxygen sensor) based on the heater resistance-temperature transfer function and the equation for oxygen sensor temperature to maintain the determined amount of power, as indicated at 410. For example, by incorporating the heater resistance-temperature transfer function and the equation for the temperature of the oxygen sensor over time into the equation for the heater power, the voltage may be calculated as: $V^2=((T_0+r_{max}\times t-T_x)\times X(maf)+r_{max}\times C_h)\times(m\times(T_0+r_{max}\times t)+b)$. Thereby, the amount of power supplied to the oxygen sensor heater during the heat up period may be kept constant even as the resistance of the oxygen sensor heater changes.

At 412, it is determined if the oxygen sensor temperature greater than a threshold temperature. For example, the threshold temperature may be a positive, non-zero temperature value, such as a light-off temperature of the oxygen sensor. As an example, the light-off temperature may be in a range between 720 and 830° C. (e.g., 800° C.). While operating above the light-off temperature, the oxygen sensor may accurately measure an amount of oxygen in the exhaust gas, enabling closed-loop fuel control (e.g., as described with respect to FIG. 2).

If the oxygen sensor temperature is not greater than the threshold temperature, method 400 returns to 408 to continue supplying voltage to the oxygen sensor heater to provide the determined amount of power (e.g., as determined at 406). In this way, the oxygen sensor will continue to be heated at the maximum heating rate by supplying a constant amount of power until the oxygen sensor reaches its light-off temperature, for example.

If the oxygen sensor temperature is greater than the threshold temperature, method 400 proceeds to 414 and includes maintaining the oxygen sensor temperature via closed-loop oxygen sensor heater control, as described above. By adjusting the voltage supplied to the oxygen sensor heater based on the resistance of the oxygen sensor after light-off, the oxygen sensor may be maintained at the desired operating temperature. Following 414, method 400 ends.

By supplying a constant amount of power to the oxygen sensor heater during an engine cold start condition instead of a constant amount of voltage, the duration of the oxygen sensor heat up period may be reduced while avoiding oxygen sensor degradation. By reducing the duration of the oxygen sensor heat up period, closed-loop fuel control may be achieved more quickly, which may reduce vehicle emissions and increase fuel economy during the engine cold start.

Thus, in one example, method 400 of FIG. 4 may include a first condition occurring, determining the first condition, and in response thereto, increasing a duty cycle of voltage supplied to a heater of an oxygen sensor as a function of time as a resistance of the heater increases; and a second condition occurring, determining the second condition, and in response thereto, varying the duty cycle of the voltage supplied to the heater as a function of the resistance. As an example, the first condition may include an engine operating in a cold start condition and/or the oxygen sensor operating at a temperature that is less than a threshold temperature, and the second condition may include the engine not operating in a cold start condition and/or the oxygen sensor operating at a temperature that is greater than or equal to the threshold temperature. The threshold temperature may be a light-off temperature of the oxygen sensor, for example, which may be a predetermined condition of the oxygen sensor. The controller may determine from among each of the first condition and the second condition based on, for example, one or more of an engine coolant temperature, a resistance of the heater, and ambient temperature. At a given time while the engine is operated, one of the first condition and the second condition is present. For example, the first condition is present while the second condition is not present, and the first condition is not present while the first condition is present. Thus, the method includes operating (e.g., with the engine on and combusting air and fuel) in one of the first condition and the second condition. Further, the first condition may include maintaining a constant amount of power supplied to the heater, with the constant amount of power determined based on a heat capacity of the oxygen sensor, a mass airflow, an exhaust temperature, and a maximum heating rate, and the second condition may include maintaining the oxygen sensor at a desired temperature that is above the threshold temperature.

Further, instructions stored in memory may include determining the first condition from one or more of an engine coolant temperature sensor, a resistance of the heater, and an ambient temperature sensor, and in response thereto, heating the oxygen sensor at a constant rate by instructions for sending a signal to the heater; and determining the second condition from the resistance of the heater, and in response thereto, maintaining the temperature of the oxygen sensor by instructions for sending a different signal to the heater. For example, the instructions stored in memory may include determining the resistance (R) based on the voltage applied to the heater (V) and a resulting heater current (I), such as according to the equation: $R=V/I$. Further, the instructions stored in memory may include determining the temperature (T) of the oxygen sensor based on the resistance, such as according to a resistance-temperature transfer function: $R=m\times T+b$. Further still, instructions stored in memory may include measuring an amount of oxygen in exhaust gas from the engine while operating in the second condition and not while operating in the first condition, and using the measured amount of oxygen in the exhaust gas for generating a fuel command while operating in the second condition.

Next, FIG. 5 shows an example timeline 500 for controlling an oxygen sensor heater during an engine cold start, such as according to method 400 of FIG. 4. The oxygen sensor heater (e.g., heater 307 of FIG. 3) may be configured to heat an oxygen sensor included in an exhaust system of a vehicle (such as UEGO sensor 126 of FIG. 1). Engine speed is shown in plot 502, engine temperature is shown in plot 504, exhaust temperature is shown in plot 506, heater voltage is shown in plot 508, oxygen sensor temperature is shown in plot 510, heater duty cycle is shown in plot 512, heater current is shown in plot 514, heater power is shown in plot 516, and heater resistance is shown in plot 518. For all of the above, the horizontal axis represents time, with time increasing along the horizontal axis from left to right. The vertical axis represents each labeled parameter, with a value of each labeled parameter increasing from bottom to top. Furthermore, a threshold engine temperature below which the engine is in a cold start condition is indicated by dashed line 520, a threshold oxygen sensor temperature corresponding to a light-off temperature of the oxygen sensor is indicated by dashed line 522, a maximum heater duty cycle is indicated by dashed line 524, and a maximum heater current is indicated by dashed line 526.

Prior to time t1, the engine is off, with an engine speed of zero (plot 502). For example, the vehicle is off (e.g., an ignition of the vehicle is in an "off" position, and the vehicle is powered down). The engine temperature (plot 504) is less than the threshold engine temperature (dashed line 520), indicating that the engine is cold. For example, the engine is at ambient temperature ("ambient"). With the engine off, the exhaust temperature (plot 506) and the oxygen sensor temperature (plot 510) are also at ambient temperature. No voltage is supplied to the oxygen sensor heater (plots 508 and 512), and thus, both the heater current (plot 514) and the heater power (plot 516) are zero. In the example of timeline 500, the heater is engineered to have decreased resistance compared with a conventional oxygen sensor heater. Therefore, at ambient temperature, the heater has a smaller, constant resistance (plot 518) than the conventional oxygen sensor heater (plot 518*a*).

At time t1, the engine is started responsive to a vehicle key-on event. For example, a vehicle operator may switch the ignition of the vehicle into an "on" position, powering on the vehicle and cranking the engine to a non-zero speed (plot 502). Because the engine temperature (plot 504) is less than the threshold engine temperature (dashed line 520) when the engine is started, a cold start condition is present. In response to the cold start condition at time t1, the oxygen sensor is heated by applying a less than maximum duty cycle of voltage to the oxygen sensor while providing constant heater power, such as according to the method of FIG. 4. For example, a controller (e.g., controller 12 of FIG. 1) may determine the heater power (plot 516) and the corresponding heater voltage (plot 508) (and the heater duty cycle to achieve the corresponding heater voltage) based on one or more of a heat capacity of the oxygen sensor, the exhaust temperature (plot 506), an initial temperature of the oxygen sensor (e.g., ambient temperature), MAF (e.g., as measured by a MAF sensor, such as MAF sensor 122 of FIG. 1), and a resistance-temperature transfer function of the oxygen sensor heater. Therefore, at time t1, the heater duty cycle is increased from zero (plot 512) to a duty cycle value that is less than the maximum duty cycle (dashed line 524). Due to the low heater resistance at time t1 (plot 518), the heater current (plot 514) reaches the maximum heater current (dashed line 526) despite the less than maximum heater duty cycle. Furthermore, because the oxygen sensor temperature (plot 510) is less than the threshold temperature (dashed line 522) and has not reached light-off, oxygen measurements made by the oxygen sensor are inaccurate. Therefore, the engine is operated with open-loop fuel control in which an amount of fuel delivered to the engine is determined based on MAF and engine temperature and without feedback from the oxygen sensor.

Between time t1 and time t2, the heater voltage increases (plot 508) as the heater duty cycle increases (plot 512) to maintain the constant heater power (plot 516). As a result, the oxygen sensor temperature increases at a constant rate (plot 510). Due to the constant rate of temperature increase (e.g., a maximum heating rate), the heater resistance also increases linearly (plot 518). As the heater resistance increases, the heater current decreases (plot 514) due to an inverse relation of current and resistance (e.g., $$I = \sqrt{\frac{P}{R}},$$

where I is current, P is power, and R is resistance).

At time t2, the oxygen sensor temperature (plot 510) reaches the threshold oxygen sensor temperature (dashed line 522). In response to the oxygen sensor temperature reaching the threshold temperature, the oxygen sensor heater is transitioned to closed-loop control in order to maintain the oxygen sensor temperature at a desired operating temperature, as described with respect to FIG. 4. Further, at time t2, the engine is transitioned to closed-loop fuel control, such as the control architecture described with respect to FIG. 2, which reduces vehicle emissions and increases fuel economy. While the oxygen sensor heater is operated with closed-loop control, the heater power is decreased and is no longer held constant (plot 516). Further, the heater duty cycle (and heater voltage) is varied in order to maintain the oxygen sensor temperature at a desired operating temperature (or temperature range) above the threshold oxygen sensor temperature. Thus, the oxygen sensor heater voltage (plot 508) reaches a peak at time t2 and then is decreased, as the oxygen sensor is no longer heated at the constant rate.

If instead the conventional oxygen sensor heater were used with conventional heater control strategies, a constant heater voltage would be supplied between time t1 and time t2 (dashed plot 508*a*), such as by supplying voltage at or near the maximum duty cycle (dashed plot 512*a*). As a result, the heater power would decrease (dashed plot 516*a*) as the heater resistance increased (dashed plot 518*a*). Further, as the heater resistance increased, the heating rate would decrease, as shown by dashed plot 510*a* (e.g., the positive slope of dashed plot 510*a* decreases in magnitude as the temperature increases). Due to the decreasing heater power, the decreasing heating rate, and the higher resistance of the conventional oxygen sensor heater, the conventional oxygen sensor would not reach the threshold oxygen sensor temperature (dashed line 522) until time t3, which is over twice as long as a duration between time t1 and time t2. During the longer duration between time t1 and time t3, the engine is operated with open-loop fuel control, which prolongs the increased emissions and reduced fuel economy.

In this way, by engineering a heater of an oxygen sensor with decreased resistance and providing constant heater power prior to the oxygen sensor reaching its light-off temperature (e.g., during an engine cold start), an amount of time before the oxygen sensor reaches its light-off temperature may be substantially (e.g., >50%) decreased, enabling faster oxygen sensing. When the oxygen sensor is included in an exhaust system of an engine, by decreasing the amount of time before the oxygen sensor reaches the light-off temperature, an amount of time the engine is operating with open-loop fuel control may be decreased, thereby reducing vehicle emissions and increasing fuel economy.

The technical effect of providing constant power to an oxygen sensor heater during an engine cold start is that the oxygen sensor is quickly heated at a constant rate, reducing an amount of time for the oxygen sensor to reach its light-off temperature and thereby reducing vehicle emissions.

As one example, a method comprises: applying a less than maximum duty cycle of voltage to a heater of an oxygen sensor during an engine cold start; and adjusting the applied duty cycle of voltage to provide a target amount of power. In the preceding example, additionally or optionally, the target amount of power is constant and is determined based on a heat capacity of the oxygen sensor. In any or all of the preceding examples, additionally or optionally, adjusting the applied duty cycle of voltage includes increasing the applied duty cycle of voltage as a function of time to maintain a substantially constant heating rate. In any or all of the preceding examples, additionally or optionally, the substantially constant heating rate is a maximum heating rate to prevent degradation of the oxygen sensor, and the target amount of power is further determined based on heat loss due to convection and the maximum heating rate. In any or all of the preceding examples, additionally or optionally, the heat loss due to convection is determined based on an exhaust gas temperature and a convection coefficient, and the convection coefficient is a function of mass airflow. In any or all of the preceding examples, the method additionally or optionally further comprises, after a threshold oxygen sensor temperature is reached, varying the amount of power applied to the oxygen sensor heater based on a resistance of the oxygen sensor heater. In any or all of the preceding examples, additionally or optionally, the threshold oxygen sensor temperature is a light-off temperature of the oxygen sensor. In any or all of the preceding examples, additionally or optionally, applying the less than peak duty cycle of voltage maintains a heater current below a threshold current.

As a second example, a method comprises: providing a constant amount of power to an oxygen sensor heater immediately following an indication to start an engine even as a resistance of the oxygen sensor heater changes with temperature until a predetermined condition of an oxygen sensor is achieved. In the preceding example, additionally or optionally, the predetermined condition is the oxygen sensor reaching a predetermined operating temperature where output current of the oxygen sensor is proportionate to a concentration of oxygen sensed via the oxygen sensor. In any or all of the preceding examples, additionally or optionally, providing the constant amount of power raises a temperature of the oxygen sensor to the predetermined operating temperature at a constant rate. In any or all of the preceding examples, additionally or optionally, the constant amount of power is based on a heat capacity of the oxygen sensor. In any or all of the preceding examples, additionally or optionally, the constant amount of power is further based on the constant rate and heat loss while the oxygen sensor is heated to the predetermined operating temperature. In any or all of the preceding examples, additionally or optionally, the heat loss includes heat transferred to exhaust gas through convection. In any or all of the preceding examples, additionally or optionally, providing the constant amount of power includes increasing an amount of voltage supplied to the oxygen sensor heater over time. In any or all of the preceding examples, the method additionally or optionally further comprises, after the predetermined condition of the oxygen sensor is achieved, providing a varying amount of power to the oxygen sensor heater.

As a third example, a system comprises: an engine configured to combust a mixture of air and fuel; an exhaust passage for expelling exhaust gas from the engine; an oxygen sensor coupled to the exhaust passage configured to measure an amount of oxygen in the exhaust gas, the oxygen sensor having a heater; an emission control device coupled to the exhaust passage downstream of the oxygen sensor; and a controller storing executable instructions in non-transitory memory that, when executed, cause the controller to: increase a duty cycle of voltage supplied to the heater to a peak as a resistance of the heater increases until the oxygen sensor reaches a threshold temperature, then vary the duty cycle of voltage as a function of the resistance. In the preceding example, additionally or optionally, the threshold temperature is a light-off temperature where oxygen sensor output is proportional to a concentration of oxygen sensed by the oxygen sensor, and the controller additionally or optionally holds further instructions in non-transitory memory that, when executed, caused the controller to: measure the amount of oxygen in the exhaust gas while varying the duty cycle of voltage as a function of the resistance and not measure the amount of oxygen while increasing the duty cycle of voltage supplied to the heater to the peak as the resistance of the heater increases; and use the measured amount of oxygen to control a ratio of the mixture of air and fuel. In any or all of the preceding examples, additionally or optionally, increasing the duty cycle of voltage supplied to the heater includes maintaining a constant amount of power provided to the heater. In any or all of the preceding examples, the system additionally or optionally further comprises an exhaust gas temperature sensor coupled to the exhaust passage upstream of the emission control device and a mass airflow sensor coupled to an intake passage of the engine, and increasing the duty cycle of voltage supplied to the heater includes determining the duty cycle of voltage as a function of time, an exhaust gas temperature measured by the exhaust gas temperature sensor, and a mass airflow measured by the mass airflow sensor.

In another representation, a method comprises: in a first condition, increasing a duty cycle of voltage supplied to the heater to a peak as a resistance of the heater increases; and in a second condition, varying the duty cycle of voltage as a function of the resistance. In the preceding example, additionally or optionally, the first condition includes a temperature of the of the exhaust gas oxygen sensor being less than a first threshold temperature and a temperature of the emission control device being less than a second threshold temperature, and the second condition includes the temperature of the exhaust gas oxygen sensor being at or above the first threshold temperature. In any or all of the preceding examples, the method additionally or optionally further comprises: measuring the amount of oxygen in the exhaust gas in the second condition and not in the first condition; and using the measured amount of oxygen to control a ratio of the mixture of air and fuel. In any or all of the preceding examples, the first threshold temperature is a light-off temperature of the exhaust gas oxygen sensor, at or above which exhaust gas oxygen sensor output is proportional to a concentration of oxygen sensed by the exhaust gas oxygen sensor, and the second threshold temperature is a light-off temperature of the emission control device, at or above which the emission control device operates at maximum efficiency. In any or all of the preceding examples, additionally or optionally, increasing the duty cycle of voltage supplied to the heater includes adjusting the duty cycle of voltage based on a resistance-temperature transfer function of the heater to maintain a constant amount of power provided to the heater.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An oxygen sensor heater control method, comprising: providing a single power value to an oxygen sensor heater included in an oxygen sensor immediately following an indication to start an engine, even as a resistance of the oxygen sensor heater changes with temperature, until a temperature of the oxygen sensor reaches a predetermined operating temperature, where providing the single power value includes increasing an amount of voltage supplied to the oxygen sensor heater over time without decreasing the amount of voltage supplied to the oxygen sensor heater until the temperature of the oxygen sensor reaches the predetermined operating temperature.

2. The method of claim 1, wherein the predetermined operating temperature is a light-off temperature of the oxygen sensor at or above which an output current of the oxygen sensor is proportionate to a concentration of oxygen sensed via the oxygen sensor.

3. The method of claim 2, wherein providing the single power value raises the temperature of the oxygen sensor to the predetermined operating temperature at a constant rate.

4. The method of claim 3, wherein the single power value is based on a heat capacity of the oxygen sensor.

5. The method of claim 4, wherein the single power value is further based on the constant rate and heat loss of the oxygen sensor while the oxygen sensor is heated to the predetermined operating temperature.

6. The method of claim 5, wherein the heat loss of the oxygen sensor includes heat transferred to exhaust gas through convection.

7. The method of claim 1, further comprising, after the temperature of the oxygen sensor reaches the predetermined operating temperature, providing a varying power value to the oxygen sensor heater to maintain the temperature of the oxygen sensor at or above the predetermined operating temperature.

* * * * *